US006895926B1

(12) United States Patent
Moreau et al.

(10) Patent No.: US 6,895,926 B1
(45) Date of Patent: May 24, 2005

(54) DEVICE FOR REGULATING FLOW IN A DUCT PORTION OR AN INTAKE PASSAGE AND MANIFOLD COMPRISING SAME

(75) Inventors: Fabien Moreau, Orbey (FR); Richard Komurian, Turckheim (FR)

(73) Assignee: Mark IV Systems Moteurs (Societe Anonyme), Courbevoie (FR)

( * ) Notice: Subject to any disclaimer, the term of this patent is extended or adjusted under 35 U.S.C. 154(b) by 0 days.

(21) Appl. No.: 10/069,507

(22) PCT Filed: Aug. 31, 2000

(86) PCT No.: PCT/FR00/02413

§ 371 (c)(1),
(2), (4) Date: Aug. 14, 2002

(87) PCT Pub. No.: WO01/16473

PCT Pub. Date: Mar. 8, 2001

(30) Foreign Application Priority Data

Aug. 31, 1999 (FR) ..... 99 10999

(51) Int. Cl.[7] ..... F02D 9/10

(52) U.S. Cl. ..... 123/336; 123/337; 123/184.61; 251/305

(58) Field of Search ..... 123/336, 337, 123/184.61; 251/305

(56) References Cited

U.S. PATENT DOCUMENTS

| | | | | |
|---|---|---|---|---|
| 5,813,380 A | | 9/1998 | Takahashi et al. | |
| 5,875,758 A | * | 3/1999 | Fujita | 123/336 |
| 5,979,871 A | * | 11/1999 | Forbes et al. | 251/305 |
| 5,992,369 A | * | 11/1999 | Mehne | 123/184.21 |
| 6,098,586 A | * | 8/2000 | Bloomer | 123/184.21 |

FOREIGN PATENT DOCUMENTS

| | | | |
|---|---|---|---|
| DE | 38 33 846 A1 | 4/1989 | F02B/31/00 |
| EP | 0 886 063 A2 | 12/1998 | F02M/35/10 |
| FR | 2 606 115 | 5/1988 | F16K/1/36 |
| WO | WO 96/31692 | 10/1996 | F02M/35/10 |

* cited by examiner

*Primary Examiner*—Erick Solis
(74) *Attorney, Agent, or Firm*—Chapman and Cutler LLP

(57) ABSTRACT

The invention concerns a device for regulating flow in a duct portion or an intake passage and a manifold comprising such a device. The device is characterized in that each valve (3)/control pin (4) assembly is incorporated in the structure of said duct portion (2) or in the structure of the part (1) comprising at least a duct portion (2), at the opening of through passage, being enclosed, with the possibility of rotating between two matching parts (2', 2" or 1', 1") forming by being assembled said duct portion (2) or said part (1) and being mounted in corresponding housing recesses (5, 5') provided in the walls of duct portions (2) and/or in one or several separate corresponding bearing(s) (6).

45 Claims, 10 Drawing Sheets

14
13
9,11
3
9'
4
3
9,11
1''
1'
6
10
2'
6
1
2
2'
16
1
6,12
9,11
10
9'
4
3
9,11
6,12
5
3
5

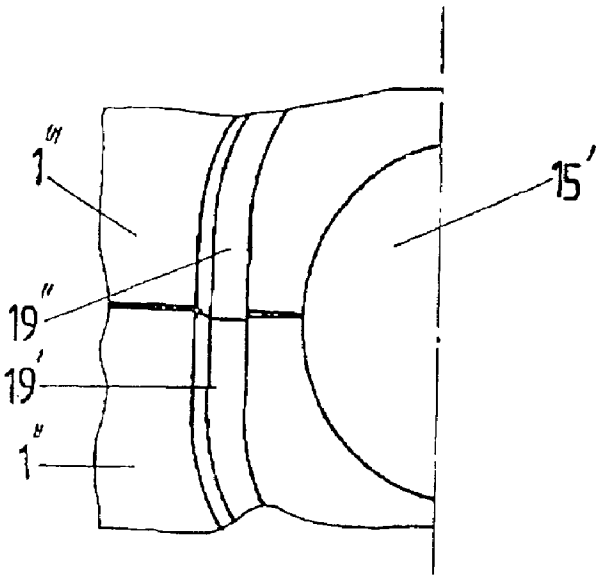
Fig-8B
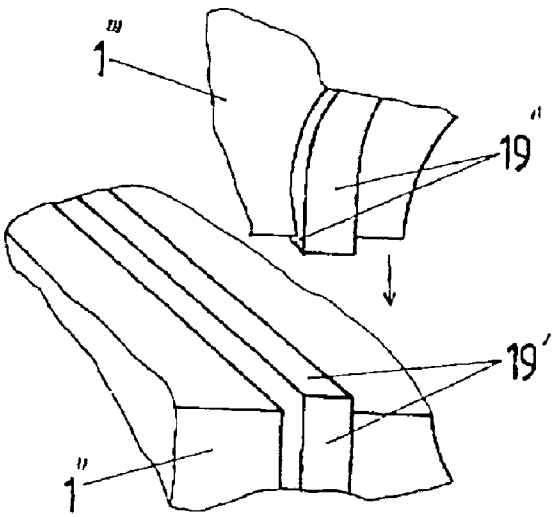
Fig-8A
Fig-8

17
19'''
15'
19''
19'
1''
1'

1'''
15'
1''
19''
19'

DEVICE FOR REGULATING FLOW IN A DUCT PORTION OR AN INTAKE PASSAGE AND MANIFOLD COMPRISING SAME

The present invention relates to the field concerning the control of flow in fluids, in particular gases, and more particularly in the framework of air intake for combustion engines, for example in connection with intake manifolds, but also and more generally to devices for regulating flow in an intake passage by means of an element placed within said intake passage and drivable by means of a control shaft.

More precisely, the object of the present invention is a device for regulating flow in a duct portion or an intake passage, a manifold comprising said device et a method to produce such manifold.

At present the interconnection of a device for regulating or controlling flow in an intake passage of a duct portion or similar is generally carried out with one or more particular operations both by mounting a transversal insert supporting the regulation element in said duct portion after cutting a suitable opening within said portion, and by placing an intermediate duct segment equipped with said regulation element between two spaced parts of said duct portion.

However, these known methods require both the production of complex inserts, comprising beyond the regulation element also a wall portion or pre-mounted supporting structures whose inner and sealed assembly with the wall portions housing the duct portion or similar is quite difficult to be carried out, and the supply and installation of additional adjustment or integration intermediate or intercalary parts, whose only aim is the mounting of said regulation element and which are no structural part belonging to said duct portion or similar.

Furthermore, these known methods generally give rise to embrittlement areas on the assembly planes or lines of the different structural parts (attached pieces) and require technical operations or additional pieces for fabricating the duct portion or similar (with no regulation device).

Moreover, the assemblies obtained with these known methods have bulky overall dimensions because of their structure and generally of a displaced and protruding control.

The present invention aims in particular at obviating at least some of these disadvantages.

To this purpose its object is a device for regulating the flow of a fluid, in particular a gas, in at least a duct portion, an intake passage or similar by means of a valve or of a similar revolving obstruction element, supported by a control shaft, characterized in that each assembly valve/control shaft is integrated into the structure of the duct portion concerned or into the structure of the piece comprising at least a duct portion, within a through opening, being blocked rotatably between two complementary parts forming by assembly, by friction or by vibration welding said duct portion or said piece and being mounted in corresponding housing recesses obtained in the walls of the duct portions and/or in one or more corresponding separated or displaced bearings.

The invention will be better understood thanks to the following description of preferred embodiments, given by way of non limiting examples and explained with reference to the attached schematic drawings, in which.

Figures 5, 5A:
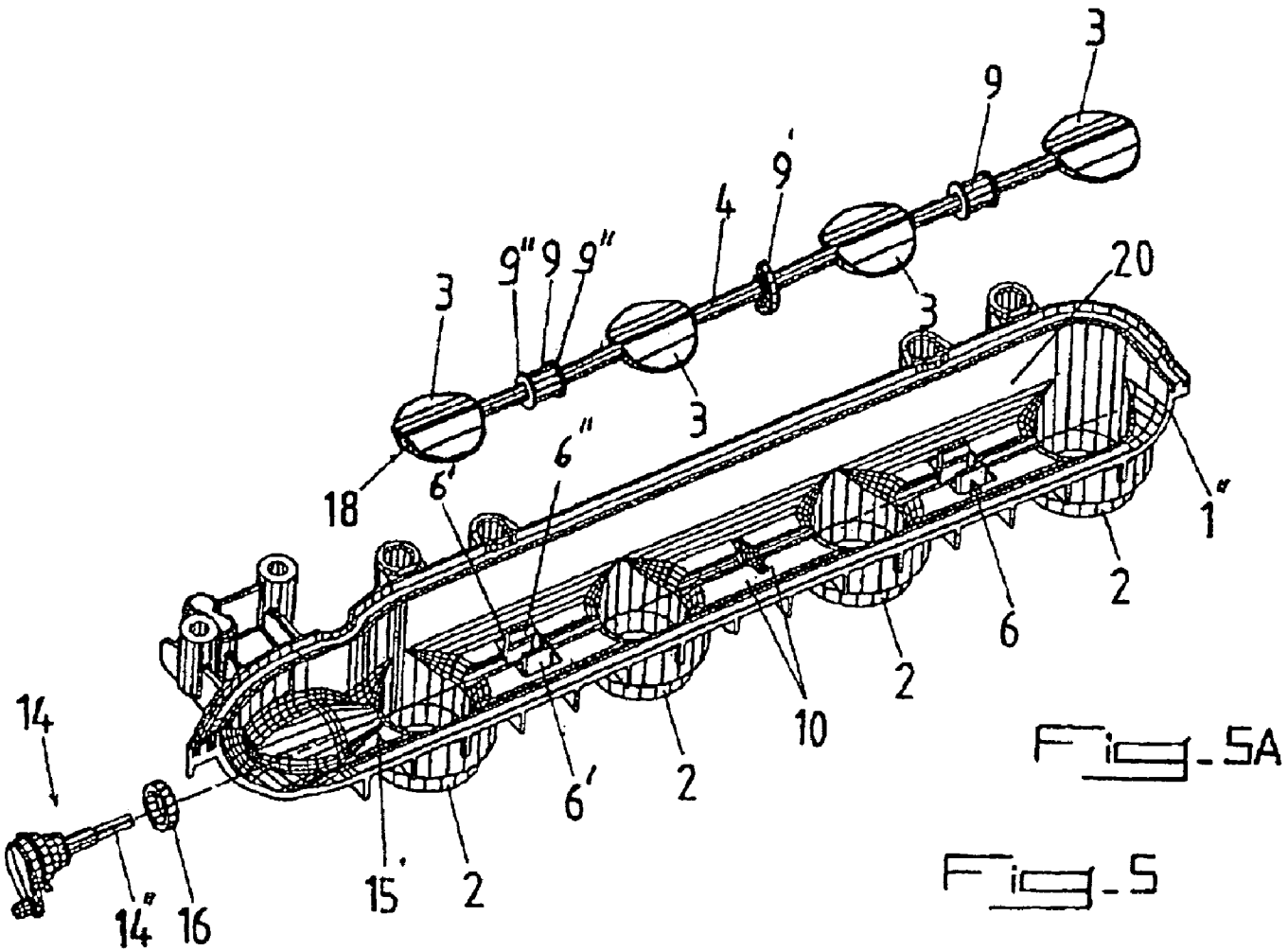
FIGS. 5 are partial sectioned and perspective views of a part of an intake manifold, on the outlet openings of the pipes, before mounting a shaft equipped with valves (FIG. 5A), after mounting said shaft (FIG. 5B) and after mounting the transmission means and the actuator (FIG. 5C), according to second embodiment of the invention.
Figure 8:
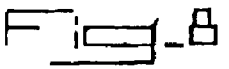
Figure 8D:
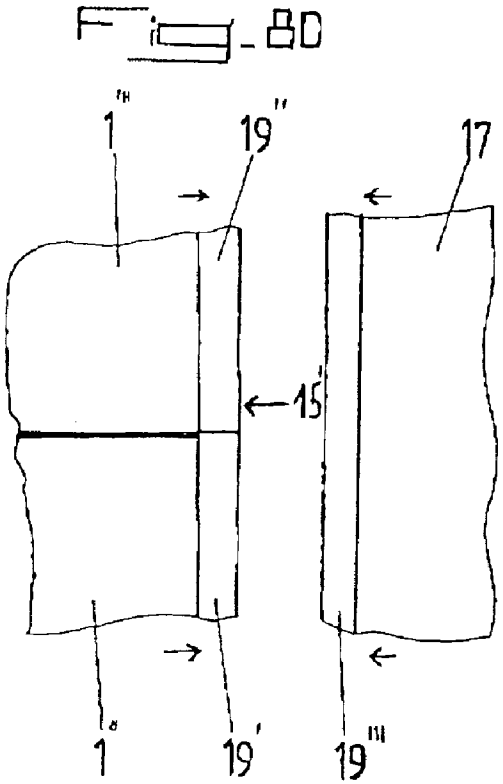
Figure 8C:
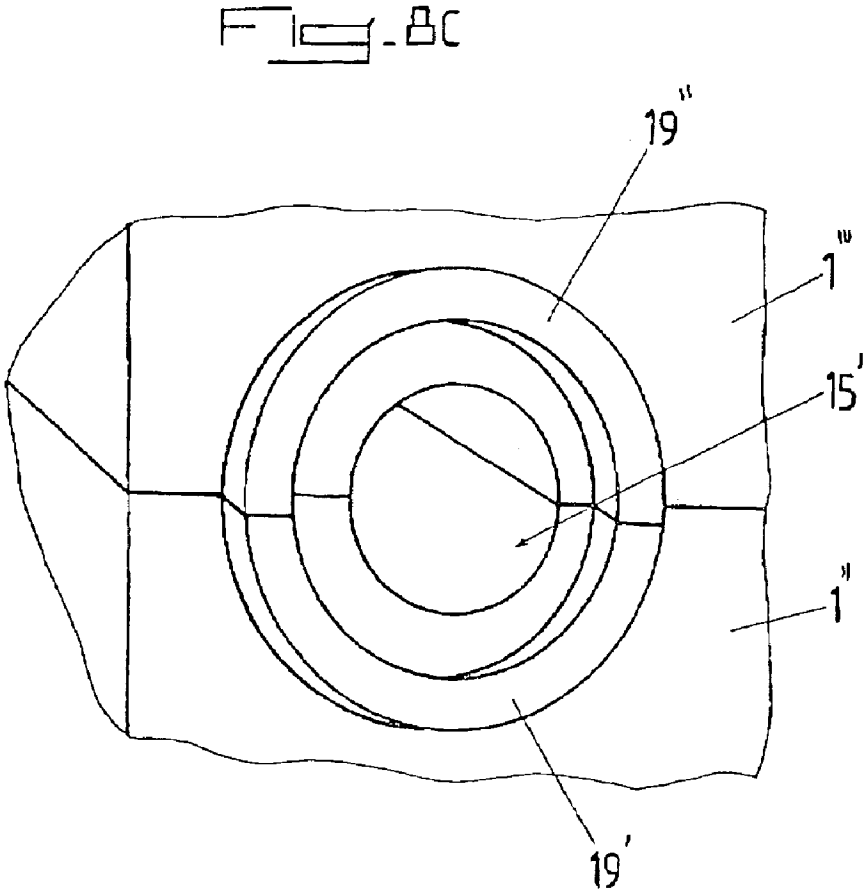
Figure 9:
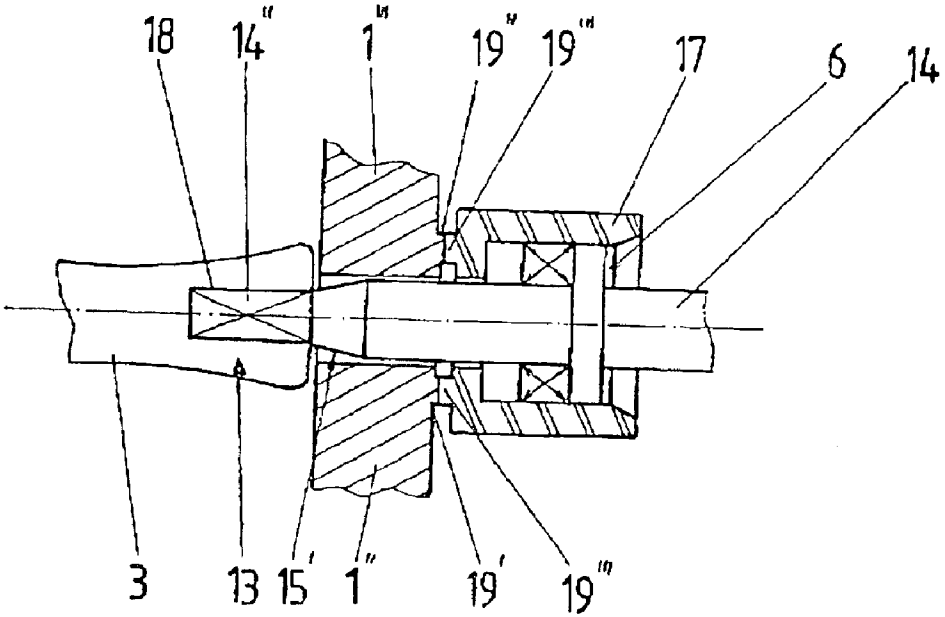

FIGS. 8 are schematic partial representations showing the assembly by vibration welding of two parts of a manifold in the area of an intake passage (FIGS. 8A, 8B and 8C: front perspective views), and its sealing by assembling a third part onto the outer surface of said passage (FIG. 8D: view in lateral elevation), and FIG. 9 is a sectional view in lateral elevation of the solution shown in FIG. 8D adapted to the intake passage 15' of the manifold shown in FIG. 5, according to another embodiment of the invention.

The figures of the attached drawings show a device for regulating the flow of a fluid, in particular a gas, in at least a duct portion 1, an intake passage, an opening or similar (for instance a portion of a circulation circuit of any fluid) by means of a valve 3 or of a similar revolving obstruction element, supported by a control shaft 4.

According to the invention each assembly valve 3/control shaft 4 is integrated into the structure of the duct portion 2 concerned or into the structure of the piece 1 comprising at least a duct portion 2, within a through opening, being rotatably supported between two complementary parts 2', 2" or 1", 1'" forming by assembly said duct portion 2 or said piece 1 and being mounted in corresponding housing recesses 5, 5' obtained in the walls of the duct portions 2 and/or in one or more corresponding separated or attached bearings 6 which are present on at least one of the parts 1", 1'" forming piece 1.

The invention can be applied to a single duct portion 2 or to a single through opening as well as to a plurality of duct portions 2 or openings connected or not one to the other and arranged in any way one with respect to the other.

Therefore, according to a preferred embodiment of the invention, the regulation device can comprise an assembly valves 3/shaft 4 for a plurality of duct portions 2 or through openings of piece 1, each comprising a valve 3, all these valves being mounted or formed onto a single control shaft 4.

The expression "duct portion" should be understood in the present invention as any passage, circular or not, which can be obstructed by a moving element such as a valve. If necessary, said passage can be reduced to a simple through opening, the axial or longitudinal size of the duct portion 2 being in this case strongly reduced, i.e. absent.

The valves 3 can be placed in a middle part of the ducts 2 or on the outlet openings of said ducts.

Figure 1:
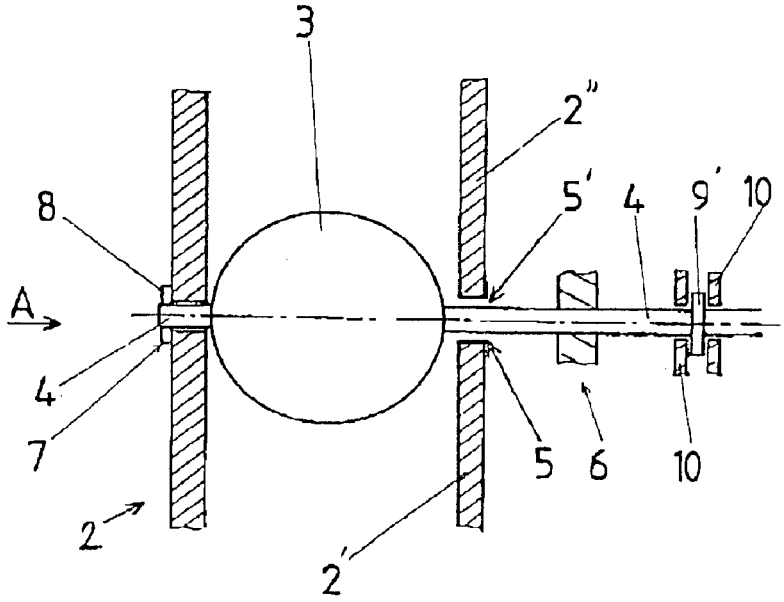
FIG. 1 is a cross section view in lateral elevation of a duct portion comprising a regulation device according to the invention.
Figure 2:
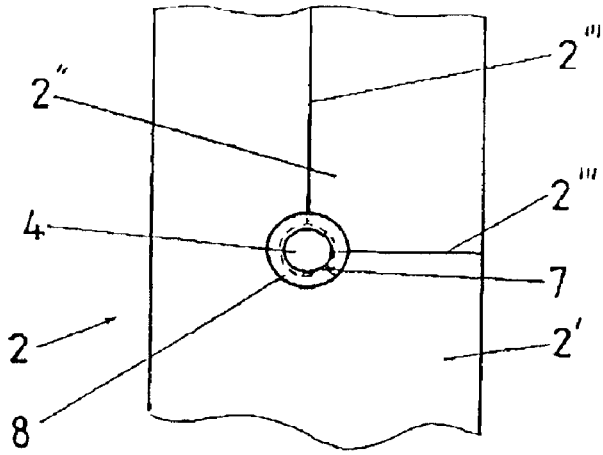
FIG. 2 is a view following arrow A of the object shown in FIG. 1.
Figure 7:
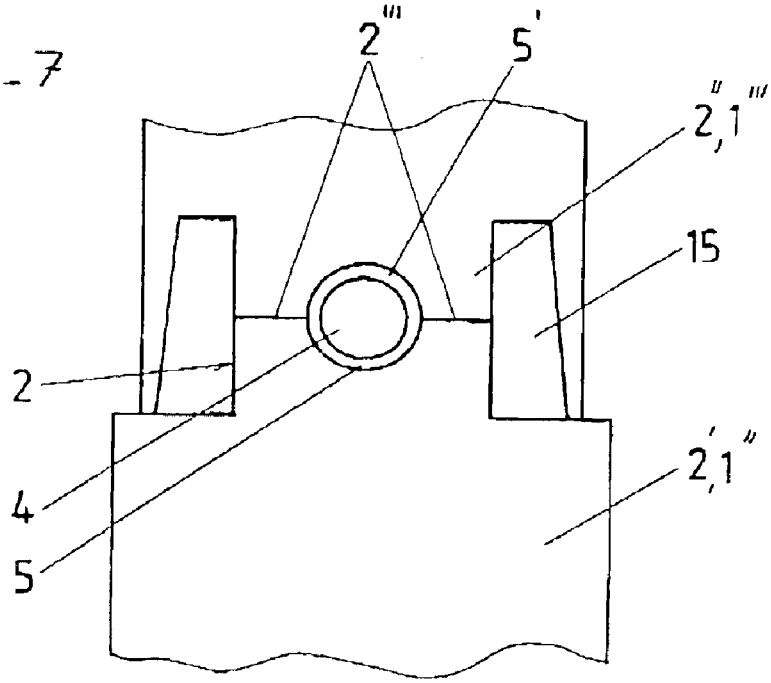
FIG. 7 is a schematic detailed view in lateral elevation of an intake pipe surrounded by a sealed case.

According to an embodiment, the control shaft 4 is "sandwiched" between parts 2', 2" constituting said at least one duct portion 2 or said piece 1, in the assembly and connection area of said parts 2', 2" or 1", 1'" (see FIGS. 1, 2 and 7).

Moreover, the assembly or connection lines 2''' deriving from the association between the assembly or connection surfaces of the two structural parts 2' and 3, can be located on a plane perpendicular to the axis of the duct portion 2 concerned, but also extend in other directions so as to simplify the assembly of the parts 2' and 2''.

The assembly and connection surfaces should only be defined so as to end into at least one of the housing recesses 5, 5' and to cut the duct portion 2 concerned so as to enable the installation of the assembly control shaft 4/valve(s) 3 in at least one of the structural parts 2' and 2'' or between them.

According to another embodiment of the invention, the control shaft 4 is placed on one of the ends of the duct 2 and is fixed to wall portions (connecting for instance two adjacent ducts) in points shifted with respect to the duct wall.

The supporting and guiding functions of the control shaft 4 supporting the valve or valves 3 for its positioning and rotation can be achieved by means of different technical solutions which are described by way of non limiting examples in the following.

So, according to a first embodiment of the invention shown in particular in FIGS. 1, 2, 3 and 4, the support of control shaft 4 and its rotation can be guaranteed, partly at least, by at least a bearing 6 outside the wall or walls of the duct portion(s) 2 or of the piece 1 concerned, if necessary obtained by assembling two complementary parts, each of them being present on one of parts 1'' and 1''' or pre-formed only on one of the two aforesaid parts.

The control shaft 4 can advantageously be mounted rotatably on one or more bearings 6 displaced with respect to the walls of the duct(s) 2 and formed on one 1'' of the two parts 1'', 1''' of piece 1, said shaft 4 being fixed and positioned by blocking it elastically on said bearings 6, 12 and said shaft 4 being blocked between said parts 1'', 1''' without any contact with the other one 1''' of said two parts 1'', 1''' either with the shaft 4 or the valves 3, or with the bearings 6.

Figures 3, 3A, 3B:
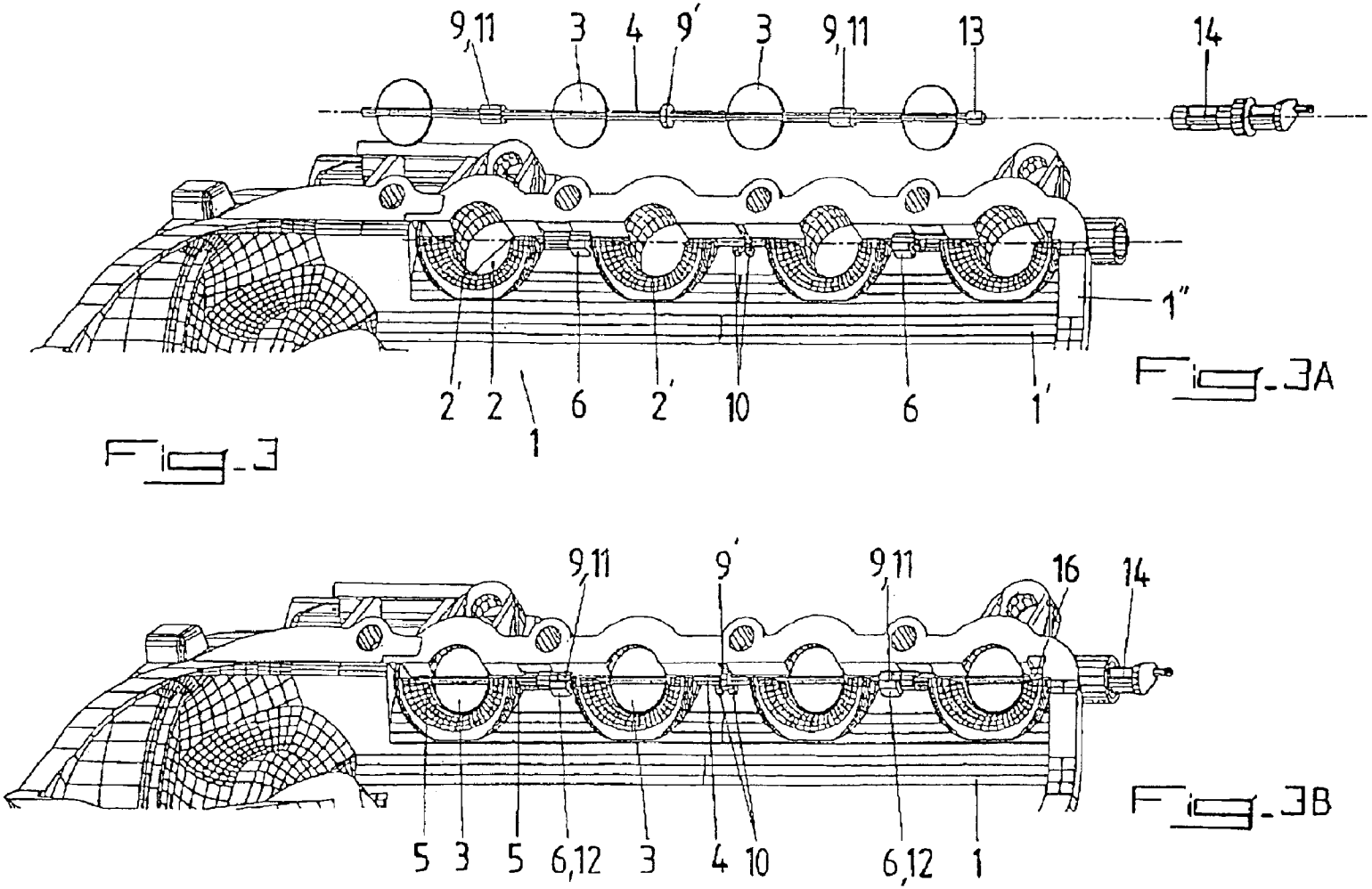
FIGS. 3 are perspective and partially sectioned views of an intake manifold before (FIG. 3A) and after (FIG. 3B) mounting a control shaft equipped with valves on a manifold or dispenser wall part containing structural parts of the intake pipes, according to a first embodiment of the invention.
Figure 4:
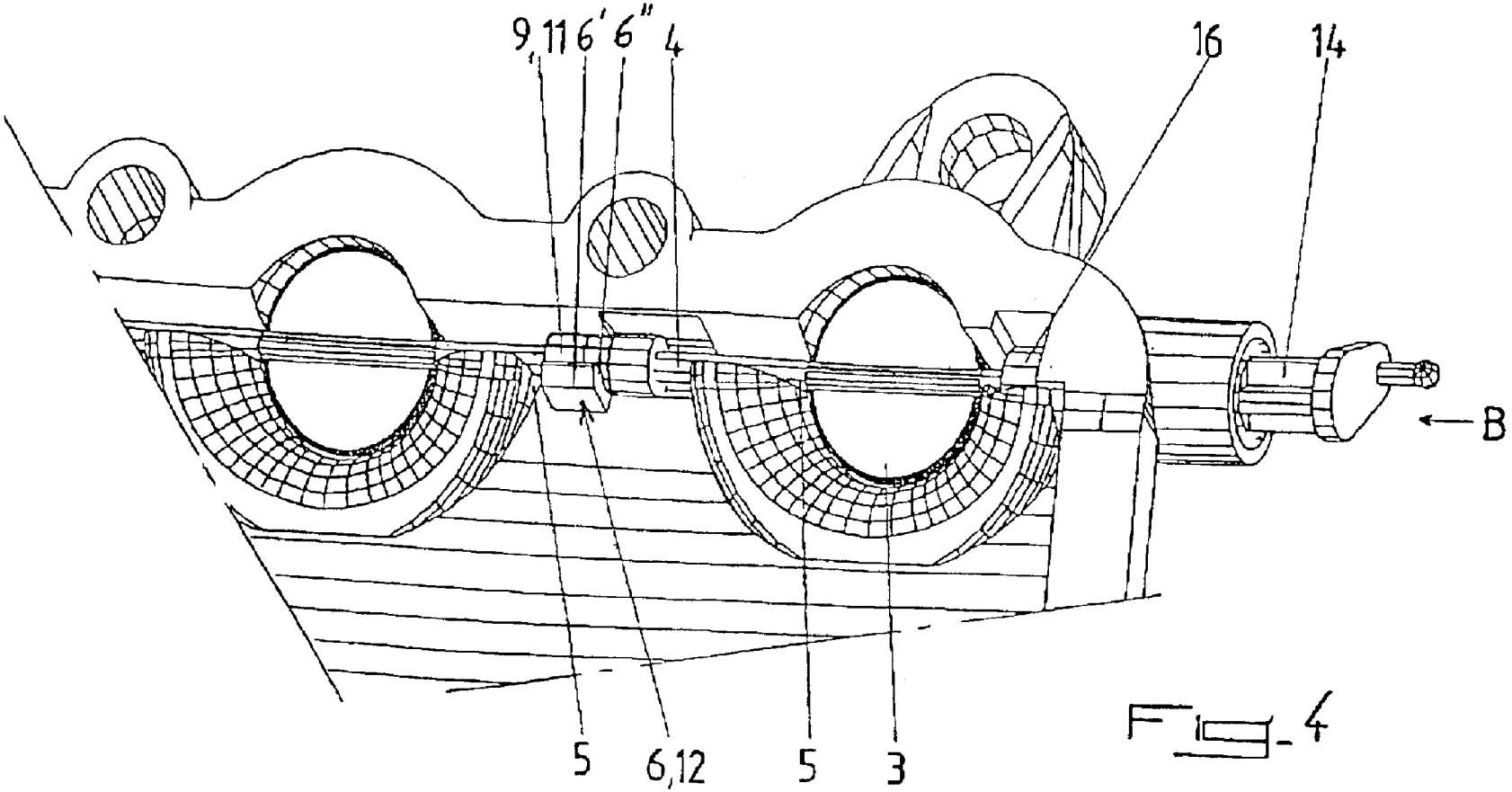
FIG. 4 is a detailed view on a different scale of a part of the object shown in FIG. 3B.

Said bearings 6 can consist for instance of a generally U-shaped structure with one or two deformable or resilient wings or tangs 6' forming together or with an additional element said bearings 6 provided with a tapered opening holding elastically the shaft 4 after its introduction by displacing said wings equipped with opposite holding nibs 6'' (see in particular FIGS. 3, 4 and 5).

In this embodiment of the invention, which can be applied in particular when the assembly shaft 4/valve(s) is placed on the outlet opening of the duct or ducts 2, none of the supporting or guiding bearings is located on the wall of the duct(s) 2 (see in particular FIGS. 3 and 5).

According to a second embodiment shown in FIGS. 1 and 2 of the attached drawings, at least one of the supporting and rotation guiding bearings 7 of the control shaft 4 can be obtained by cooperation of the opposite housing recesses 5, 5' located in the connecting areas of the walls of the two parts 2', 2'' or 1', 1''' forming the duct portion(s) 2 or piece 1, said supporting or guiding bearings 7 being possibly sealed with or without the interposition of an attached sealing element 8.

In order to simplify the rotation of the shaft 4 and to position it in the two aforesaid embodiments, said control shaft 4 can comprise one or more cylinder-shaped protuberances 9 or ring-shaped (disk-shaped) protuberances 9', obtained as one piece with said shaft 4 or attached onto the latter by over-forming or mounting, whose function is to cooperate with the supporting or guiding bearings 6, 7 or with translation blocking stops 10 of said control shaft 4.

The protuberances 9, 9' can advantageously be made of a wear-resisting material and/or of a material having a low coefficient of friction with the material constituting the supporting and guiding bearings 6 and 7, said ring-shaped protuberances 9 having the shape of sleeves possibly having disk-shaped stops 9'' on their opposite longitudinal ends so as to form translation blocking sites of shaft 4 after its mounting.

According to a third embodiment of the invention shown in FIGS. 3 and 4 of the attached drawings, the control shaft 4 can also comprise one or more rotation guiding bearings 11 which are pre-mounted, blocked and clamped in supporting bearings 12 obtained during the assembly of the two parts 2' and 2'' or 1'' and 1''' constituting the duct portion(s) 2 or piece 1.

The pre-mounted rotation guiding bearings 11, for instance in the form of roll or roller bearings, can possibly be completely inserted into the supporting bearings 12 so as to protect them and block their movement, which makes stops 10 useless.

It is obvious for people skilled in the art that the supporting and guiding function of the control shaft 4 can be achieved both using only ore of the solutions described above or combining them together.

The assembly control shaft 4/valve(s) 3 can be obtained both by fixing (for instance by welding, screwing, clipping, bending or other methods) metal valves onto an shaft (made or not of metal), and by over-forming the valves onto a metal or plastic shaft (the guiding protuberances 9 or the bearings 11 being installed on the shaft before or after the over-forming operation), or also by forming as one piece an assembly shaft/valves in plastic.

The assembly between parts 2' and 2'' constituting duct portion 2 and/or between parts 1'' and 1''' constituting piece 1 can also be achieved with different methods, such as for instance mechanical connection, gluing, welding or others, according to the material constituting said parts 2' and 2'' or 1'' and 1'''.

It should also be pointed out that the control shaft 4 can be placed centrally with respect to the valve(s) 3 or, if necessary, shifted, so as not to disturb the flow when said valves 3 are open or in a position of maximum passage (see on this subject French patent application no. 99 02531 issued to the Applicant).

However, according to a preferred embodiment of the invention, the two parts 2' and 2'' or 1'' and 1''' constituting duct portion 2 and/or piece 1 are made of thermoplastic material and assembled by vibration welding, the connection planes being configured and arranged so as to enable, if necessary, the installation of the assembly control shaft 4/valve(s) 3 on or within one at least of said two parts or between them.

The holes for the shaft 4 can be sealed by forming a gasket during assembly, by means of a separate sealing element attached before or after assembly, or by attaching an additional part or piece 17 by vibration welding onto the outer surface of the hole(s) concerned, said additional part containing, if necessary, an axially sealed supporting and guiding bearing 6, 12.

The achievement of this third solution is shown in particular in FIGS. 8 and 9 of the attached drawings.

As shown by said figures, the hole 15' is formed first of all during assembly of pieces 1' and 1''' by overlapping on the opposite portions of their weld beads 19' and 19'' (FIGS. 8A and 8B), so as to obtain a transversally sealed passage 15' whose outer outlet opening is surrounded (on the outer surface of piece 1) by two semicircular weld bead portions (FIG. 8C) forming together a circular bead surrounding said opening.

The coincident circular bead 19''' of a sealed piece 17 is then applied onto the two semicircular beads 19' and 19'', said elements being then assembled by vibration welding (FIG. 8D: view in lateral elevation), so as to obtain a sealed assembly of pieces 1 and 17.

Another object of the present invention is also an intake manifold or splitter 1 comprising at least one, and preferably a plurality of intake pipes 2 in the form of duct portions connecting the chamber 20 of the manifold or dispenser with the heads, and obtained by assembling at least two complementary parts 1'', 1''' in thermoplastic material by vibration welding (see FIGS. 3 to 5 and 7 to 9).

Said intake manifold or splitter 1 is characterized in that at least some of the pipes 2 or through openings of the latter, and preferably all of them, comprise a regulation device such as the one described above, integrated into the structure of said manifold or dispenser 1 and forming an assembly for flow regulation comprising a plurality of valves 3 mounted or formed onto a unique control shaft 4 passing through said intake pipes 2 or through openings and provided on one of its ends with an interconnecting element 13, in particular at least a rotation coupling element, with a transmission means 14 connected with an actuator 14' or directly equipped with an actuator.

Said actuator 14' can be of pneumatic, electric, mechanical or other type.

According to a preferred embodiment of the invention, the control shaft 4 provided with valves 3 extends transversally near one of the ends of the intake pipes 2, i.e. as far as its connection area with wall 1' of the chamber 20 of manifold 1 or as far as its connection area with the fixing plate on the heads, the supporting bearings 12 and, if necessary, the guiding bearings 6, 7, as well as the translation blocking stops 10 of the control shaft 4 being at least partially, and preferably completely, formed onto said wall 1' of the manifold chamber 20 or onto said fixing plate.

Said stops 10 can consist both of protuberances of wall 1' (FIGS. 3) and of recesses of the latter (FIGS. 5).

In particular, said assembly control shaft 4/valves 3 can be placed on the interface intake pipe 2/chamber 20 of manifold 1 or on the interface intake pipe 2/heads. In particular in the first case, the assembly can be "sandwiched" between two parts 1'' and 1''' forming the chamber 20 of said manifold or splitter and having an assembly or connection plane or line going across said interface area pipe/manifold on the outlet openings of said pipes within the chamber 20 of said manifold (FIGS. 3 to 5).

According to another embodiment of the invention, shown in particular in FIGS. 3 to 5, 7 and 9 of the attached drawings, the control shaft 4 freely goes (without contact) through the walls of the intake pipes 2 concerned or extends through the openings of said pipes 2 getting into the chamber 20 of manifold 1, the assembly of the structural parts 1'', 1''' of manifold 1 creating a sealed case 15 around the connection areas of the assembly of said intake pipes 2 together with wall 1' of manifold 1 or where said pipes 2 get into the chamber 20 of manifold 1, the piece formed by the assembly control shaft 4/valves 3 being mounted by introduction into bearings 6, 12 pre-formed onto the wall 1' of one 1'' of the pieces 1'', 1''' forming manifold 1, on cylinder-shaped protuberances 9 or on bearing portions 11 formed or attached onto shaft 4, the other one 1''' of said pieces 1'', 1''' possibly preventing the coming out of shaft 4 from said bearings 6, 12 after assembling the two pieces 1' and 1'''.

According to first embodiment of the invention, shown in particular in FIGS. 3, 4 and 5 of the attached drawings, said sealed case 15 is completed on opening 15 for the portion of control shaft 4 getting out and supporting the interconnecting element 13, or for the re-entrant handling bar 14'' of the transmission means 14, by means of a ring-shaped axial plug 16, shrink-fitted or tight-fitted or welded onto said opening 15' (said plug possibly supporting sealing elements for the passage of shaft 4 or being itself a sealing element while enabling the rotation of the handling bar 14'' and/or of means 14).

According to another embodiment, shown in particular in FIG. 9 of the attached drawings, the sealed case 15 formed by assembling the two parts 1'' and 1''' of manifold 1 is closed on the opening 15' for the portion of control shaft 4 getting out and supporting the interconnecting element 13 or for the re-entrant handling bar 14'' of the transmission means 14, by interconnection, by vibration welding, on the opening or on the outer surface of said passage 15', by means of a third hollow part 17 closing at least a component of the transmission means 14 and/or at least an axially sealed bearing 6, 12, said third part 17 being interconnected after forming piece 1.

Figures 5, 5B:
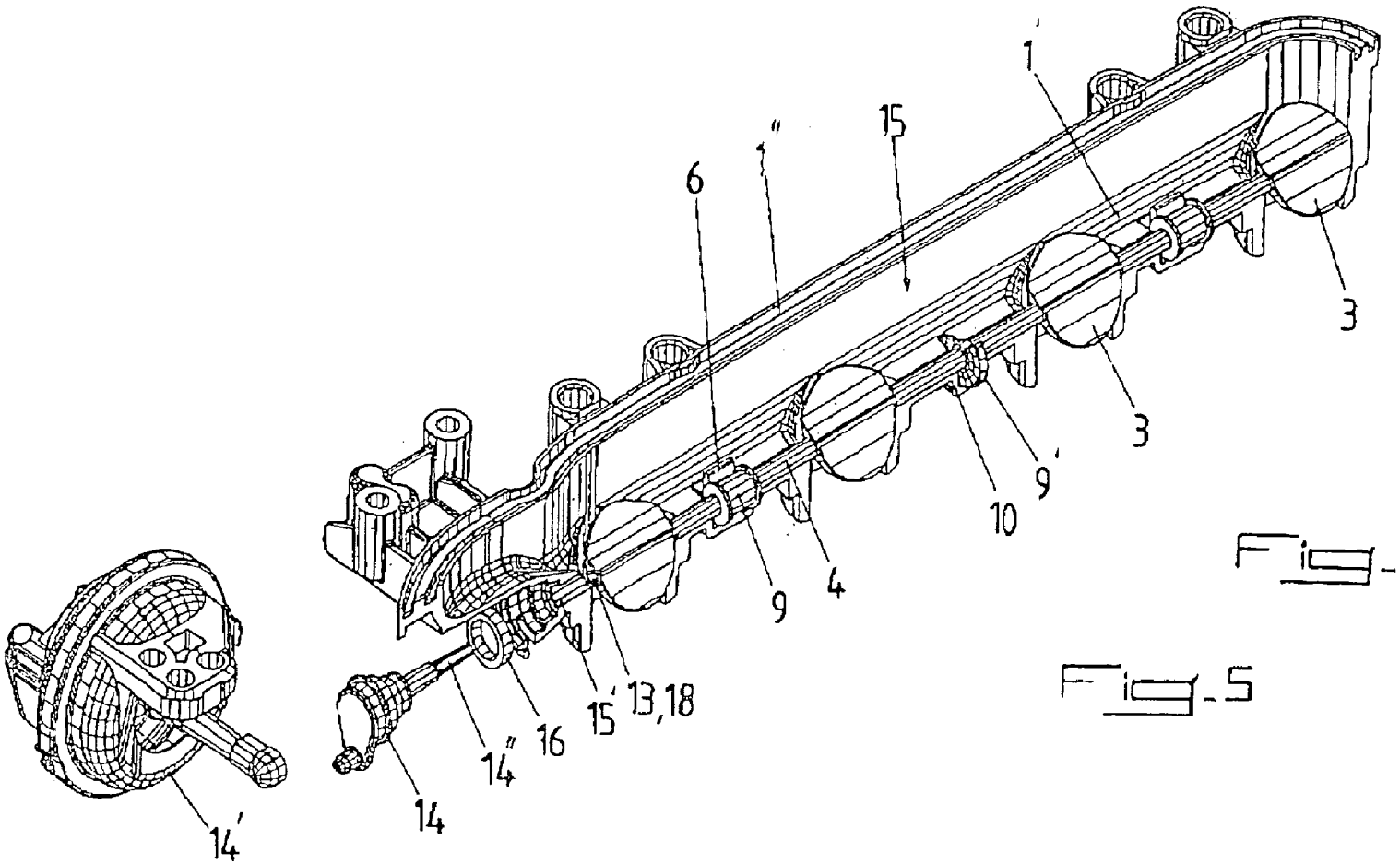
Figures 5, 5C:
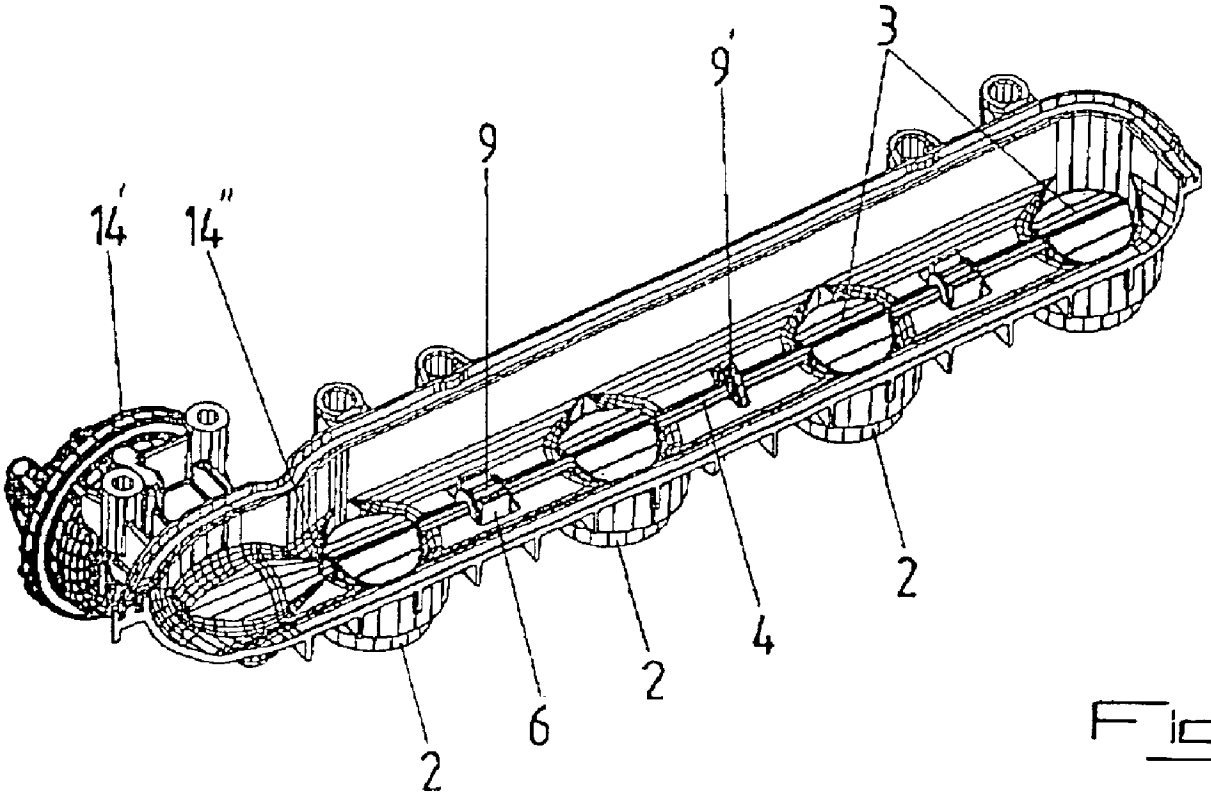
Figure 6:
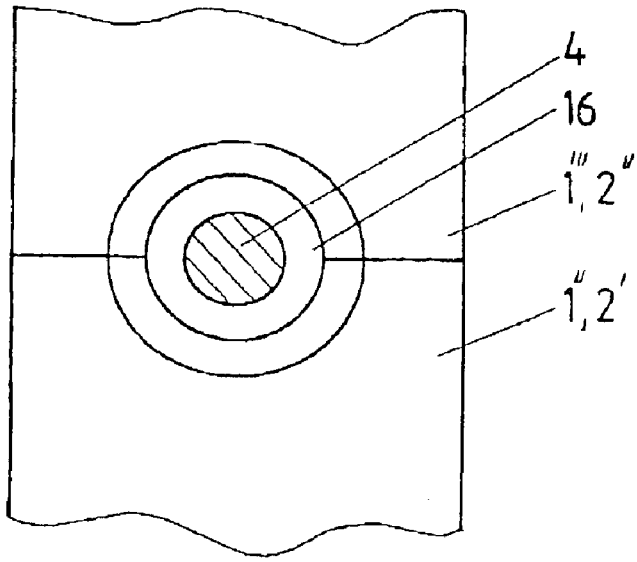
FIG. 6 is a detailed view following arrow B of the plug shown in FIG. 5 (the transmission means 14 having been removed)

Preferably, as shown in FIGS. 5A, 5B and 5C of the attached drawings, the assembly shaft 4/valves 3 fully extends within the sealed case 15, the shaft 4 not going across the welding assembly areas or lines, the two valves 3 at the opposite ends of shaft 4 being mounted protrudingly and valve 3 positioned near the opening 15' being provided with an axial blind channel 18, for instance with rectangular section, housing by coupling the end of handling bar 14'' and forming the interconnecting element 13.

As shown in FIG. 3A of the attached drawings, the interconnecting element 13 can alternatively be in the form of a square-section extension of control shaft 4, connected with a female piece having a housing sleeve with complementary shape (for instance by clipping, by gluing, by tight fitting and/or shrink fitting or similar) being part of the transmission means 14 connected with an actuator.

The driving gear of control shaft 4 can enable the shifting of valves 3 between an opening and a closing position (complete or not), the extreme positions being defined by one or more mechanical stops connected with the control shaft and preferably located near the actuator 14'. The shifting between the opening and closing positions can be carried out both with a full/empty pattern and proportionally.

So, the connection between control shaft 4 and transmission means 14 can be carried out both outside and preferably inside the sealed case formed during the assembly of the two structural parts 1'' and 1''' of manifold 1, the aforesaid female or male piece thus sealingly extending through a corresponding through opening 15'.

Moreover, a further object of the present invention is a method to produce an intake manifold or splitter 1 such as the one described above, starting from at least two parts 1', 1''' made of thermoplastic material.

Said method essentially consists in providing a first part 1'' of an intake manifold 1, in installing on or within said first part 1'' and within recesses 5, 5' and/or portions of suitable supporting or guiding bearings 6, 12, a control shaft comprising a plurality of valves 3 arranged each within a through opening or a part passage 2' of corresponding intake pipe 2, in providing at least a second part 1''' of the intake manifold (1) comprising, if necessary, the complementary parts 2'' of intake pipes 2 and in arranging it or them in assembling position with the first part 1'' blocking or "sandwiching" the control shaft 4 with valves 3, and finally in assembling by vibration welding said at least two parts 1'', 1''' of intake manifold 1.

The second part 1''' can both participate directly in blocking the assembly shaft 4/valves 3 being in direct contact with said assembly ("sandwiching" and fitting shaft 4 between the two parts 1" and 1'", possibly on the assembly line between the two parts 2' and 2" of duct portions 2) and be only a covering portion or a cover for the first part 1", the latter assuring, if necessary, only the supporting and rotation guiding functions of the assembly shaft 4/valves 3.

So, advantageously, as shown in FIGS. 3 and 5 of the attached drawing, the mounting of the assembly shaft 4/valves 3 is achieved by fitting onto said first part 1", and the assembly of the two parts 1" and 1'" results in a sealed case 15 around said assembly except for a drawing opening 15', the latter being sealed while coupling the transmission means 14 with the control shaft 4.

The description above shows how the aim underlying the invention consists first of all in mounting the assembly control shaft 4/valve(s) 3 onto a part 1", 2' or between two parts 1" and 1'", 2' and 2" (said assembly possibly being kept in place by bearing portions 5, 5', 6 or 11), then in assembling the two parts 1" and 1'", 2' and 2" constituting the duct portion 2, the manifold or splitter 1 or any other element or structure comprising a regulation device according to the invention.

The invention allows to achieve a technical solution minimizing the number of operations which are necessary for installing and mounting the regulation device (without interfering with the fabrication method existing and without making it longer), said technical solution having small overall dimensions and enabling a complete integration of said regulation device (protection against collisions), though assuring a reliable sealing.

The invention is obviously not limited to the embodiments described and shown in the attached drawings. Changes are still possible, in particular as far as the constitution of the various elements is concerned or by replacing with technical equivalents, though without leaving the protection field of the invention.

What is claimed is:

1. Intake manifold (1) comprising a manifold chamber (20), a plurality of intake pipes (2) in the form of duct portions connecting the manifold chamber (20) with the heads and a device for regulating flow in said intake pipes comprising at least a control shaft (4) and valves (3) supported by said control shaft (4), said flow regulation device being integrated into the structure of manifold (1) and being rotatably mounted into bearings (6), said manifold (1) consisting of at least two complementary parts (1", 1'") joined one to the other, wherein the two parts (1", 1'") form complementary portions of delimiting said manifold chamber (20), the bearings (6) being formed integrally with at least one of said parts (1", 1'") delimiting said manifold chamber (20) in an assembly area of said parts (2', 2" or 1", 1'") outside said intake pipes (2).

2. Manifold according to claim 1, wherein said bearings (6) are obtained by assembling said two complementary parts (1", 1'").

3. Manifold according to claim 2, wherein the control shaft (4) is fixed and positioned by elastically inserting said shaft (4) into said bearings (6, 12).

4. Manifold according to claim 1, wherein said bearings (6) are formed onto one (1") of said parts, said shaft (4) being blocked between said parts (1", 1'") without any contact with the other one (1'") of said two parts (1", 1'"), the other part (1'") preventing the shaft (4) from coming out of said bearings (6) after the assembly of the two parts (1" and 1'").

5. Manifold according to claim 2, wherein said bearings (6) are formed onto one (1") of said parts, said shaft (4) being blocked between said parts (1", 1'") without any contact with the other one (1'") of said two parts (1", 1'"), the other part (1'") preventing the shaft (4) from coming out of said bearings (6) after the assembly of the two parts (1' and 1'").

6. Manifold according to claim 3, wherein said bearings (6) are formed onto one (1") of said parts, said shaft (4) being blocked between said parts (1", 1'") without any contact with the other one (1'") of said two parts (1", 1'"), the other part (1'") preventing the shaft (4) from coming out of said bearings (6) after the assembly of the two parts (1' and 1'").

7. Manifold according to claim 1, wherein the control shaft (4) is "sandwiched" between the parts (1', 1'") constituting said manifold (1) in the assembly and connection area of said parts (1', 1'").

8. Manifold according to claim 2, wherein the control shaft (4) is "sandwiched" between the parts (1', 1'") constituting said manifold (1) in the assembly and connection area of said parts (1', 1'").

9. Manifold according to claim 1, wherein said bearings (7) are sealed by interposing a sealing element (8).

10. Manifold according to claim 2, wherein said bearings (7) are sealed by interposing a sealing element (8).

11. Manifold according to claim 7, wherein said bearings (7) are sealed by interposing a sealing element (8).

12. Manifold according to claim 1, wherein the control shaft (4) comprises at least a cylinder-shaped protuberance (9') cooperating with translation blocking stops (10) of said control shaft (4).

13. Manifold according to claim 2, wherein the control shaft (4) comprises at least a cylinder-shaped protuberance (9') cooperating with translation blocking stops (10) of said control shaft (4).

14. Manifold according to claim 3, wherein the control shaft (4) comprises at least a cylinder-shaped protuberance (9') cooperating with translation blocking stops (10) of said control shaft (4).

15. Manifold according to claim 4, wherein the control shaft (4) comprises at least a cylinder-shaped protuberance (9') cooperating with translation blocking stops (10) of said control shaft (4).

16. Manifold according to claim 7, wherein the control shaft (4) comprises at least a cylinder-shaped protuberance (9') cooperating with translation blocking stops (10) of said control shaft (4).

17. Manifold according to claim 9, wherein the control shaft (4) comprises at least a cylinder-shaped protuberance (9') cooperating with translation blocking stops (10) of said control shaft (4).

18. Manifold according to claim 1, wherein said two complementary parts are made of thermoplastic material and are assembled by vibration welding.

19. Manifold according to claim 2, wherein said two complementary parts are made of thermoplastic material and are assembled by vibration welding.

20. Manifold according to claim 3, wherein said two complementary parts are made of thermoplastic material and are assembled by vibration welding.

21. Manifold according to claim 4, wherein said two complementary parts are made of thermoplastic material and are assembled by vibration welding.

22. Manifold according to claim 7, wherein said two complementary parts are made of thermoplastic material and are assembled by vibration welding.

23. Manifold according to claim 9, wherein said two complementary parts are made of thermoplastic material and are assembled by vibration welding.

24. Manifold according to claim 12, wherein said two complementary parts are made of thermoplastic material and are assembled by vibration welding.

25. Manifold according to claim 1, wherein said regulation device is provided on one of its ends with a rotation coupling element connected with an actuator (14').

26. Manifold according to claim 2, wherein said regulation device is provided on one of its ends with a rotation coupling element connected with an actuator (14').

27. Manifold according to claim 3, wherein said regulation device is provided on one of its ends with a rotation coupling element connected with an actuator (14').

28. Manifold according to claim 4, wherein said regulation device is provided on one of its ends with a rotation coupling element connected with an actuator (14').

29. Manifold according to claim 7, wherein said regulation device is provided on one of its ends with a rotation coupling element connected with an actuator (14').

30. Manifold according to claim 9, wherein said regulation device is provided on one of its ends with a rotation coupling element connected with an actuator (14').

31. Manifold according to claim 12, wherein said regulation device is provided on one of its ends with a rotation coupling element connected with an actuator (14').

32. Manifold according to claim 18, wherein said regulation device is provided on one of its ends with a rotation coupling element connected with an actuator (14').

33. Manifold according to claim 12, wherein said regulation device extends transversally near one of the ends of the intake pipes (2) in the connection area of said intake pipes (2) with a wall (1') of the manifold chamber (20) of manifold (1), said bearings (6, 7, 12) and said translation blocking stops (10) of the control shaft (4) being formed onto said wall (1') of the manifold chamber (20) of manifold (1).

34. Manifold according to claim 18, wherein said regulation device extends transversally near one of the ends of the intake pipes (2) in the connection area of said intake pipes (2) with a wall (1') of the manifold chamber (20) of manifold (1), said bearings (6, 7, 12) and said translation blocking stops (10) of the control shaft (4) being formed onto said wall (1') of the manifold chamber (20) of manifold (1).

35. Manifold according to claim 25, wherein said regulation device extends transversally near one of the ends of the intake pipes (2) in the connection area of said intake pipes (2) with a wall (1') of the manifold chamber (20) of manifold (1), said bearings (6, 7, 12) and said translation blocking stops (10) of the control shaft (4) being formed onto said wall (1') of the manifold chamber (20) of manifold (J).

36. Manifold according to claim 12, wherein said regulation device extends near one of the ends of the intake pipes (2) in the area where said manifold (1) is fixed onto the heads.

37. Manifold according to claim 18, wherein said regulation device extends near one of the ends of the intake pipes (2) in the area where said manifold (1) is fixed onto the heads.

38. Manifold according to claim 25, wherein said regulation device extends near one of the ends of the intake pipes (2) in the area where said manifold (1) is fixed onto the heads.

39. Intake manifold according to claim 33, wherein the assembly of the parts (1', 1''') constituting manifold (1) results in a sealed case (15) around the connection areas of the assembly of said intake pipes (2) with the wall (1') of manifold (1).

40. Intake manifold according to claim 39, wherein said sealed case (15) is completed in an area of passage (15') for the portion of the control shaft (4) getting out and supporting the rotation coupling element connected with the actuator (14') by means of a ring-shaped axial plug (16) shrink-fitted or tight-fitted or welded into said passage (15').

41. Intake manifold according to claim 39, wherein the sealed case (15) formed by assembling the two parts (1' and 1''') of manifold (1) is closed in an area of passage (15') for the rotation coupling element (14) of said control shaft, by interconnection on the outer surface of said two parts (1' and 1'''), by vibration welding, by means of a third hollow part (17) closing said rotation coupling element (14) and an axially sealed bearing (6, 12).

42. Intake manifold according to claim 40, wherein the regulation device fully extends within the sealed case (15), said shaft (4) not going across the welding assembly areas or lines, the two valves (3) at the opposite ends of shaft (4) being mounted protrudingly and the valve (3) positioned near passage (15') being provided with an axial blind channel (18) housing by insertion the end of handling bar (14'') constituting said rotation coupling element (14).

43. Intake manifold according to claim 41, wherein the regulation device fully extends within the sealed case (15), said shaft (4) not going across the welding assembly areas or lines, the two valves (3) at the opposite ends of shaft (4) being mounted protrudingly and the valve (3) positioned near passage (15') being provided with an axial blind channel (18) housing by insertion the end of handling bar (14'') constituting said rotation coupling element (14).

44. Method for producing an intake manifold, comprising the steps of:

providing a first part (1'') of an intake manifold (1), said manifold (1) comprising a manifold chamber (20), ad said first part being made of thermoplastic material;

installing on said first part and within portions of suitable supporting or guiding bearings (6, 12), a regulation device comprising a control shaft (4) and a plurality of valves (3) arranged each within a through opening or a part passage (2') of corresponding intake pipe (2);

providing at least a second part (1''') of the intake manifold (1), said second part being made of thermoplastic material, and said two parts (1', 1''') forming complementary portions delimiting said manifold chamber (20), the bearings (6) being formed integrally with at least one of said parts (1', 1''') delimiting said manifold chamber (20) in an assembly area of said parts (1', 1''') outside said intake pipe (2);

arranging said second part in assembling position with the first part (1'') blocking control shaft (4) with valves (3); and assembling by vibration welding said at least two parts (1', 1''') of intake manifold (1).

45. Method according to claim 44, wherein said regulation device is mounted onto said first part (1') and the assembly of the two parts (1' and 1''') results in a sealed case (15) around said assembly except for a drawing passage (15'), the latter being sealed when coupling the rotation coupling element (14) with the control shaft (4).

* * * * *

UNITED STATES PATENT AND TRADEMARK OFFICE

CERTIFICATE OF CORRECTION

PATENT NO. : 6,895,926 B1
DATED : May 24, 2005
INVENTOR(S) : Noreau and Komurian It is certified that error appears in the above-identified patent and that said Letters Patent is hereby corrected as shown below:

Title page,
Item [73], Assignee, the word "Systems" should be changed to -- Systemes --.

Signed and Sealed this

Nineteenth Day of July, 2005

JON W. DUDAS
*Director of the United States Patent and Trademark Office*